US010271655B1

(12) United States Patent
Gwen

(10) Patent No.: US 10,271,655 B1
(45) Date of Patent: Apr. 30, 2019

(54) COLLAPSIBLE STEP STOOL WITH A REINFORCING SUPPORT

(71) Applicant: Patrick Gwen, Houston, TX (US)

(72) Inventor: Patrick Gwen, Houston, TX (US)

( * ) Notice: Subject to any disclaimer, the term of this patent is extended or adjusted under 35 U.S.C. 154(b) by 0 days.

(21) Appl. No.: 16/034,162

(22) Filed: Jul. 12, 2018

(51) Int. Cl.
*A47C 4/10* (2006.01)
*A47C 12/00* (2006.01)

(52) U.S. Cl.
CPC ..... *A47C 4/10* (2013.01); *A47C 12/00* (2013.01)

(58) Field of Classification Search
CPC ..... A47C 4/10; A47C 12/00
See application file for complete search history.

(56) References Cited

U.S. PATENT DOCUMENTS 1,133,109 A * 3/1915 Derbyshire ..... A47B 3/0912 108/132
2,513,880 A * 7/1950 Lang ..... A47C 9/10 108/124
3,271,075 A 9/1966 Good
3,805,711 A * 4/1974 Lakso ..... A47B 23/001 108/133
4,010,699 A * 3/1977 Lakso ..... A47B 23/001 108/133
4,618,183 A * 10/1986 Bauer ..... A47C 13/00 108/12
6,039,149 A 3/2000 Bedja et al.
D655,180 S * 3/2012 Kraft ..... D9/560
D710,031 S 7/2014 Simpson et al.
2009/0261643 A1* 10/2009 Kay ..... A47C 4/20 297/335
2013/0048428 A1* 2/2013 Chancler ..... A47C 9/10 182/155
2017/0215594 A1* 8/2017 Baker ..... A47C 12/00

* cited by examiner

*Primary Examiner* — Alvin C Chin-Shue
(74) *Attorney, Agent, or Firm* — Craft Chu PLLC; Andrew W. Chu

(57) ABSTRACT

The step stool includes a front frame member, a back frame member, a first side frame member, a top panel having a top front panel and a top back panel, and a support panel member. The top front panel is hinged to the top back panel at a top side middle hinge on the midline of the top panel. The support panel member reinforces the midline of the top panel in the assembled configuration. The base end of the support panel member is aligned with the base ends of the front frame member and back frame member to support the weight on the step stool. The top front panel and the top back panel fold around the support panel in the storage configuration.

20 Claims, 4 Drawing Sheets

COLLAPSIBLE STEP STOOL WITH A REINFORCING SUPPORT

CROSS-REFERENCE TO RELATED APPLICATIONS

See Application Data Sheet.

STATEMENT REGARDING FEDERALLY SPONSORED RESEARCH OR DEVELOPMENT

Not applicable.

THE NAMES OF PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

1. Field of the Invention

The present invention relates to step stool. More particularly, the present invention relates to a collapsible step stool. Even more particularly, the present invention relates to a large reinforced step stool to support greater amounts of weight.

2. Description of Related Art Including Information Disclosed Under 37 CFR 1.97 and 37 CFR 1.98

A step stool or foot stool is a type of ladder. The step stool usually includes only a few steps to add small amounts of height to the user. As a type of miniature ladder, the step stool has a low center of gravity to reduce the risk of tipping. The step stool is self-supporting, which means that the step stool does not require another structure to remain upright for use. That is, the step stool is not leaned against a wall. Because the step stool only adds a small amount of reach, the dimensions are usually very small. A typical step stool only needs to hold two feet of a person as the user steps and stands on top of the step stool.

Several patents and patent publications have addressed the need to add small amount of heights.

U.S. Pat. No. D710,031, issued to Simpson et al on 29 Jul. 2014, shows a folding stepstool. There is a front frame member, a back frame member, a first side frame member, a second side frame member, and a top panel. The first and second side frame members are hinged to collapse the front frame member and the back frame member together in a storage configuration. The top panel is hinged to the front frame member to flip upward in the storage configuration.

U.S. Pat. No. 3,271,075, issued to Good on 6 Sep. 1966, discloses a folding foot stool with a top panel and two hinged side frames. In the storage configuration, the hinged sides fold into the top panel. In the assembled configuration, the hinged sides are folded outward from the top panel. The hinged side members abut the top panel to set the height of the foot stool in the assembled configuration.

U.S. Pat. No. 6,039,149, issued to Bedja et al on 21 Mar. 2000, teaches another style of step stool. There is a ladder portion with the steps, and a support portion hinged to the ladder portion. The storage configuration is the support portion folded into the ladder portion.

Although the collapsible step stool is known in the prior art, modern problems and broader uses of the step stool require innovations.

It is an object of the present invention to provide a step stool to support the user and cargo weight in an assembled configuration.

It is an object of the present invention to provide a step stool to support vertical and lateral movement of the user.

It is another object of the present invention to provide a step stool to support lateral movement on top of the step stool.

It is another object of the present invention to provide a step stool with a top panel with large dimensions.

It is still another object of the present invention to provide a step stool with a top panel which allows a user to move laterally across the top panel.

It is still another object of the present invention to provide a step stool with a top panel which fits more than the user's two feet on the top panel.

It is an object of the present invention to provide a step stool to support more weight on a larger top panel.

It is another object of the present invention to provide a step stool with a support member to reinforce the larger top panel in the assembled configuration for use.

It is another object of the present invention to provide a step stool with a collapsible support member to reinforce the larger top panel in the storage configuration.

It is still another object of the present invention to provide a collapsible step stool with a collapsible support member to reinforce the larger top panel in the storage configuration.

These and other objectives and advantages of the present invention will become apparent from a reading of the attached specification.

BRIEF SUMMARY OF THE INVENTION

Embodiments of the present invention include a step stool being comprised of a front frame member, a back frame member, a first side frame member, a top panel having a top front panel and a top back panel, and a support panel member. The step stool of the present invention has a length dimension that requires additional support for the top panel. Most step stools only fit the two feet of the user, and there is no room to take steps on the top panel. The step stool with the longer dimension provides the extra area for lateral movement across the top panel. The support panel member is incorporated into this type of longer step stool in order to reinforce the top panel. The support panel member and at least the front frame member and the back frame member hold the top panel relative to the ground, instead of only the front frame member and the back frame member. Additionally, the support panel member is incorporated to both the assembled configuration and the storage configuration.

The front frame member can have a front top frame end, a front first side frame end, a front second side frame end, and a front base frame end opposite the front top frame end. The front length from the front first side frame end to the front second side frame end is longer than a front height from the front top frame end to the front base frame end. Similarly, the back frame member has corresponding structures, including a back top frame end, a back first side frame end, a back second side frame end, and a back base frame end opposite the back top frame end. The back length from the back first side frame end to the back second side frame end is also longer than a back height from the back top frame end to the back base frame end.

The first side frame member can have a first side front panel and a first side back panel. The first side front panel hinges to the first side back panel at a first side middle hinge. The first side front panel is hinged to the front first side frame end of the front frame member, and the first side back panel is hinged to the back first side frame end of the back frame member. Similarly, the second side frame member can have a second side front panel and a second side back panel. The second side front panel hinges to the second side back panel at a second side middle hinge. The second side front panel is hinged to the front second side frame end of the front frame member, and the second side back panel is hinged to the back second side frame end of the back frame member.

Embodiments of the step stool include the top panel having the top front panel hinged to the top back panel at a top side middle hinge. The top front panel is hinged to the front top frame end of the front frame member, and the top back panel is hinged to the back top frame end of the back frame member. As such, the first side middle hinge, the second side middle hinge, and the top side middle hinge are aligned on a midline of the top panel.

In the present invention, this midline is reinforced by the support panel member having a support top frame end, a support first side frame end, a support second side frame end, and a support base frame end opposite the support top frame end. The support top frame end hinged to the top front panel and the top back panel at the top side middle hinge. A support length from the support first side frame end to the support second side frame end is longer than a support height from the support top frame end to the support base frame end. The support height corresponds to a height from the top panel to the front base frame end and from the top panel to the back base frame end.

In the assembled configuration of the top panel, the top front panel and the top back panel spread away from each other to form a flat surface for standing by the user. The first side front panel is also hinged away from the first side back panel, and the second side front panel is hinged away from the second side back panel for planar surfaces on the side of the step stool. The support panel member extends downward from the top panel so that the support base frame end aligns with the front base frame end and the back base frame end to support the step stool on the ground.

In the storage configuration of the top panel, the top front panel and the top back panel hinge toward each other to collapse the step stool. The first side front panel also hinges toward the first side back panel, and the second side front panel hinges toward the second side back panel. The support panel member is sandwiched between the top front panel and the top back panel. The step stool with the longer front length is reinforced to prevent failure of the top panel. The support panel member, the front frame member, and the back frame member support the weight of the step stool and any weight on the step stool, instead of only the front frame member and the back frame member.

DETAILED DESCRIPTION OF THE INVENTION

FIGS. 1-7 show the step stool 10, according to the present invention. The step stool 10 has a top surface having a rectangular shape with a length dimension greater than a width dimension. The length dimension is so much greater than the width dimension that the step stool 10 requires reinforcing in order to prevent the step stool 10 from failing. The top surface of this type of step stool allows the user to make wide lateral movement across the top surface. The user can take steps on the top surface, instead of remaining in place on the step stool 10. The weight of the user and whatever weight being held by the user must be supported across the entire length dimension. The step stool 10 provides a support panel member 70 to reinforce the top surface, when the length dimension is so much greater than the width dimension.

Figure 2:
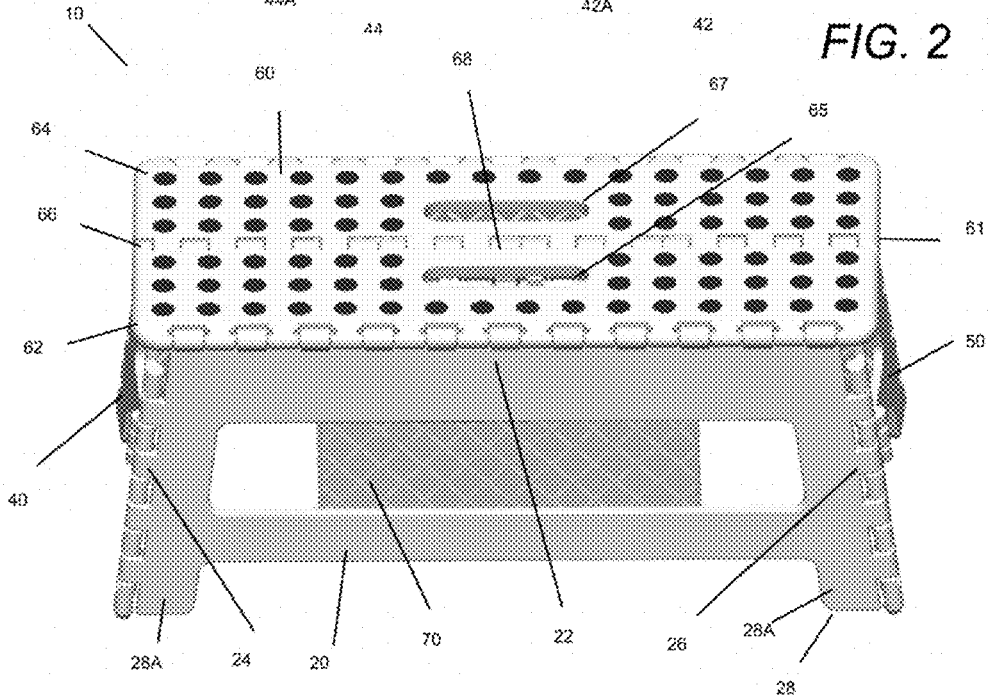
FIG. 2 is a front upper perspective view of the step stool of FIG. 1.

FIG. 2 shows a front frame member 20 having a front top frame end 22, a front first side frame end 24, a front second side frame end 26, and a front base frame end 28 opposite the front top frame end 22. In some embodiments the front base frame end 28 has front leg portions 28A so as to contact the ground. The front base frame end 28 includes that bottom edge of the front frame member 20 and supports the step stool 10 on the ground. With front leg portions 28A, there can be two front leg portions at opposite ends. For example, a front first leg portion 28A is adjacent the front first side frame end 24 and a front second leg portion 28A is adjacent the front second side frame end 26. The middle of the front frame member 20 does not contact the ground. Weight of the user is dispersed from the middle to the front leg portions 28A at opposite ends. A front length from the front first side frame end to the front second side frame end is longer than a front height from the front top frame end to the front base frame end.

Figure 3:
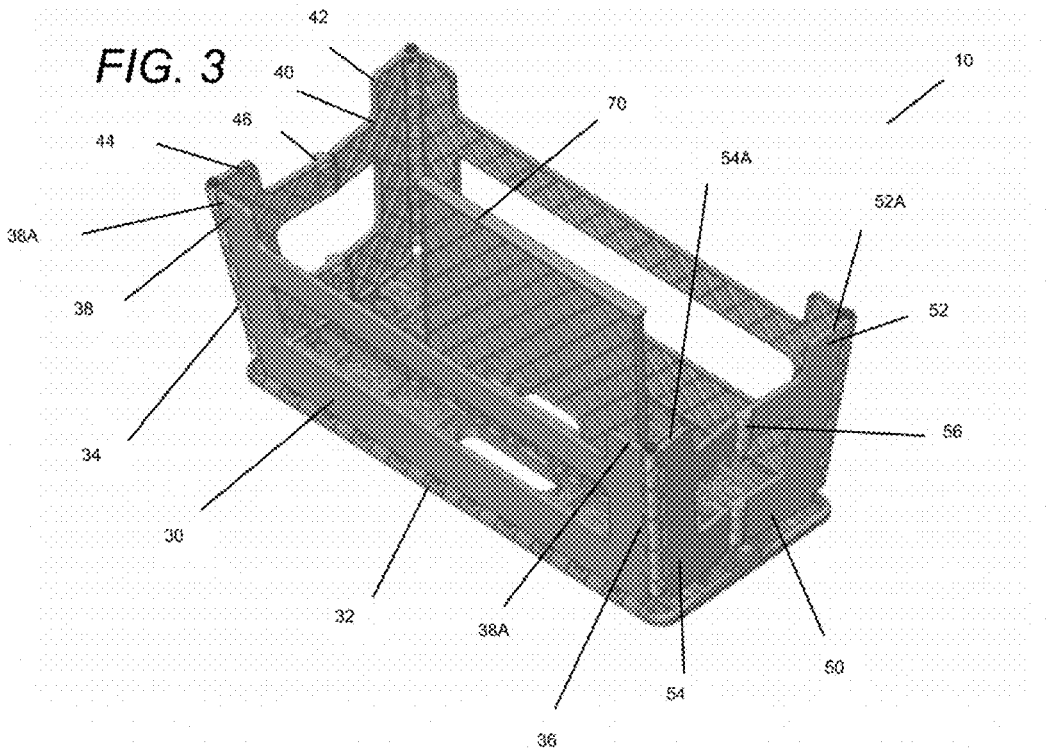
FIG. 3 is a bottom perspective view of the embodiment of the step stool according to embodiments of the present invention.

The back frame member 30 is complementary to the front frame member 20. FIG. 3 shows a back frame member 30 having a back top frame end 32, a back first side frame end 34, a back second side frame end 36, and a back base frame end 38 opposite the back top frame end 32. In some embodiments the back base frame end 38 has back leg portions 38A so as to contact the ground. The back base frame end 38 includes that bottom edge of the back frame member 30 and supports the step stool 10 on the ground. With back leg portions 38A, there can be two back leg portions at opposite ends. For example, a back first leg portion 38A is adjacent the back first side frame end 34 and a back second leg portion 38A is adjacent the back second side frame end 36. The middle of the back frame member 30 also does not contact the ground. Again, weight of the user is dispersed from the middle to the back leg portions 38A at opposite ends. A back length from the back first side frame end to the back second side frame end is longer than a back height from the back top frame end to the back base frame end.

Figure 1:
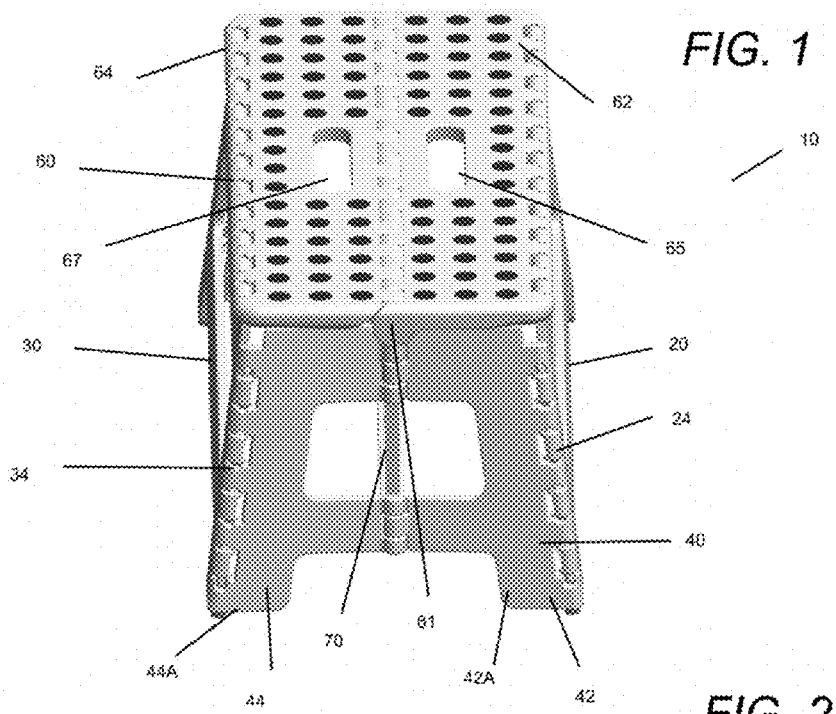
FIG. 1 is a side perspective view of the step stool according to embodiments of the present invention in the assembled configuration.

FIGS. 1 and 3 show the first side frame member 40 having a first side front panel 42 and a first side back panel 44. The first side front panel 42 hinges to the first side back panel 44 at a first side middle hinge 46. Additionally, the first side front panel 42 is hinged to the front first side frame end 24 of the front frame member 20, and the first side back panel 44 is hinged to the back first side frame 34 end of the back frame member 30.

In embodiments with the front leg portions 28A and back leg portions 38A, the first side front panel 42 is comprised of a first side front leg portion 42A, and the first side back panel 44 is comprised of a first side back leg portion 44A. The first side front leg portion 42A and the first side back leg portion 44A are placed at opposite ends of the first side frame member 40. Weight of the user is dispersed from the middle between the first side front leg portion 42A and the first side back leg portion 44A. However, the distance between the first side front leg portion 42A and the first side back leg portion 44A is less than the distance between either the front first leg portion 28A and the front second leg portion 28A or the back first leg portion 38A and the back second leg portion 38A. In some embodiments, the first side leg front leg portion 42A is adjacent said front first leg portion 28A, and the first side leg back leg portion 44A is adjacent said back first leg portion 38A.

FIG. 3 shows the complementary second side frame member 50 having a second side front panel 52 and a second side back panel 54. The second side front panel 52 hinges to the second side back panel 54 at a second side middle hinge 56. Additionally, the second side front panel 52 is hinged to the front second side frame end 26 of the front frame member 20, and the second side back panel 54 is hinged to the back second side frame 36 end of the back frame member 30.

In embodiments with the front leg portions 28A and back leg portions 38A, the second side front panel 52 is comprised of a second side front leg portion 52A, and the second side back panel 54 is comprised of a second side back leg portion 54A. The second side front leg portion 52A and the second side back leg portion 54A are placed at opposite ends of the second side frame member 50. Weight of the user is dispersed from the middle between the second side front leg portion 52A and the second side back leg portion 54A. However, the distance between the second side front leg portion 52A and the second side back leg portion 54A is also less than the distance between either the front first leg portion 28A and the front second leg portion 28A or the back first leg portion 38A and the back second leg portion 38A. In some embodiments, the second side leg front leg portion 52A is adjacent said front second leg portion 28A, and the second side leg back leg portion 54A is adjacent said back second leg portion 38A.

Figure 5:
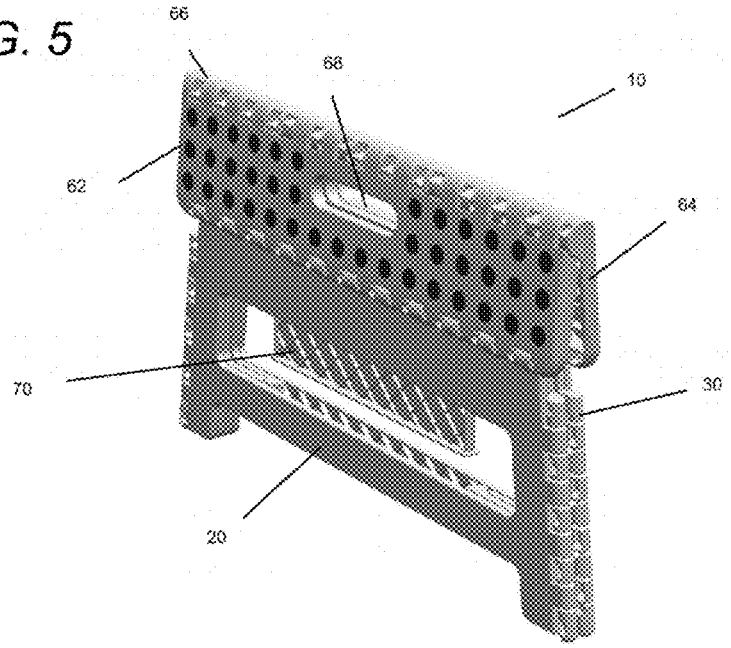
FIG. 5 is a front perspective view of the step stool according to embodiments of the present invention in the storage configuration.

FIGS. 1, 2, and 5 show the top panel 60 having a top front panel 62 and a top back panel 64. The top panel 60 forms the top surface for interacting with the user. The user places their feet on the top surface to raise the height of the user. The user is now able to reach shelves and other items placed above the regular reach of the user. When those items are heavy and difficult to balance, there is a need for the top surface to accommodate shifting position of the user and a large amount of weight greater than the user himself or herself.

Embodiments of the step stool 10 show the top panel 60 with the top front panel 62 hinged to the top back panel 64 at a top side middle hinge 66. The top front panel 62 is also hinged to the front top frame end 28 of the front frame member 20, and the top back panel 64 is hinged to the back top frame end 38 of the back frame member 30.

Figure 6:
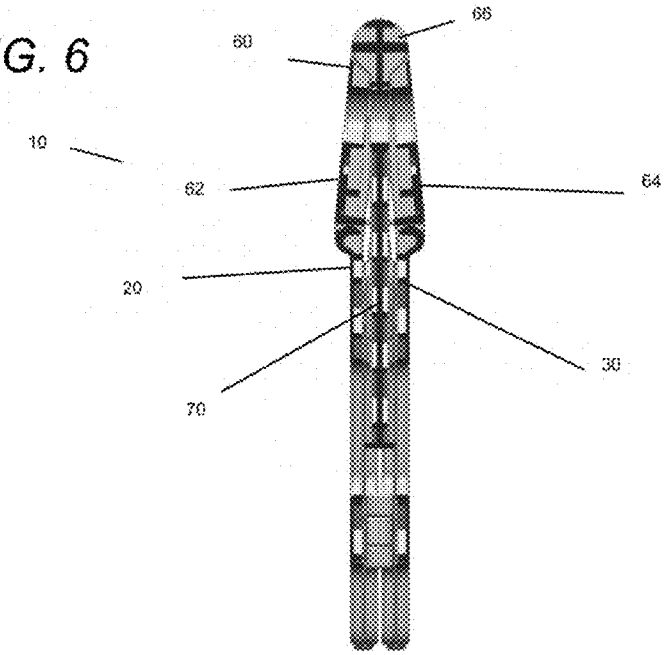
FIG. 6 is a cross-sectional view of the step stool of FIG. 5.
Figure 7:
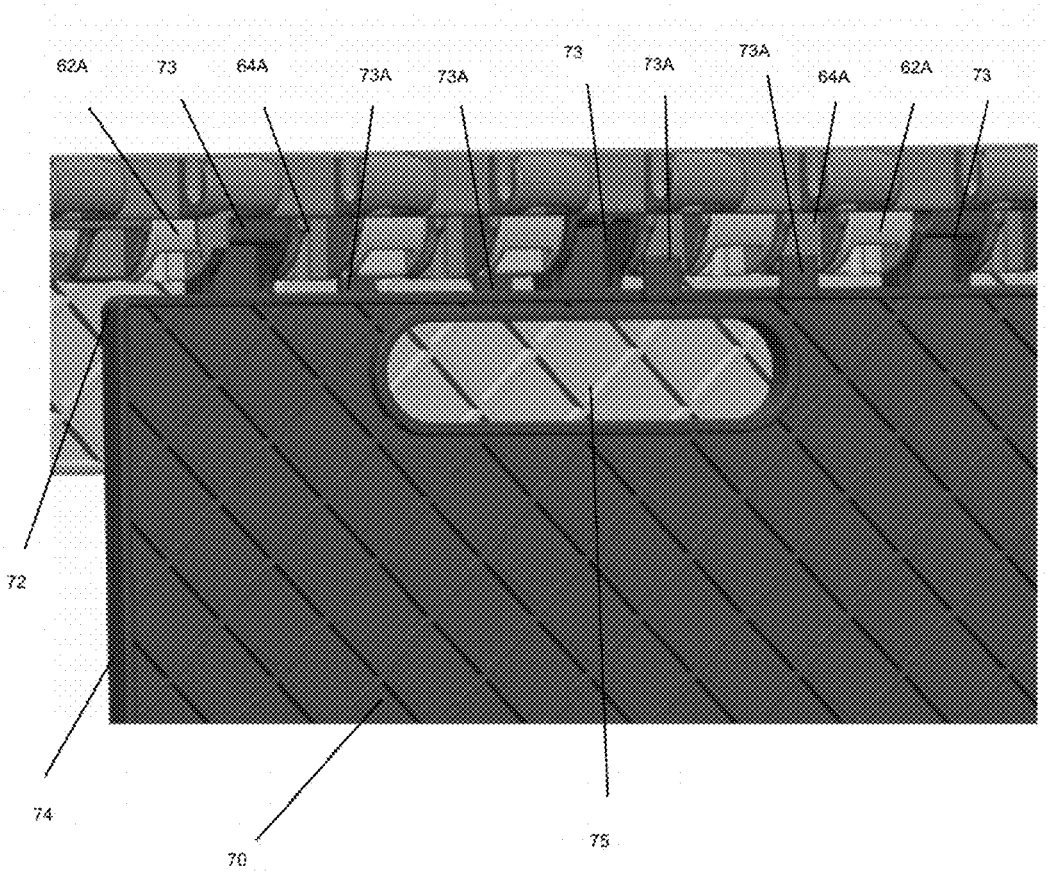
FIG. 7 is an isolated perspective view of the support member attached to the top panel of the present invention.

In the embodiments of FIGS. 1, 6 and 7, the first side middle hinge 46, the second side middle hinge 56, and the top side middle hinge 66 are aligned on a midline 61 of the top panel 60. The midline 61 of the present invention is reinforced. The weight on the midline 61 between either the front first leg portion 28A and the front second leg portion 28A or the back first leg portion 38A and the back second leg portion 38A would sag the top panel 60. The top panel 60 could rupture or collapse.

Figure 4:
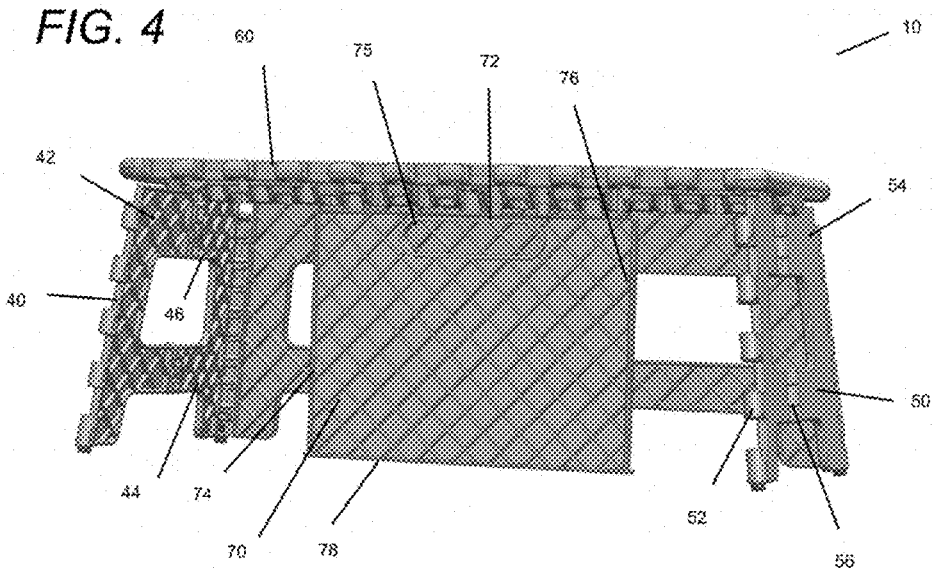
FIG. 4 is front perspective view of the step stool of FIG. 1 with the front support member removed.

FIG. 4 shows an embodiment of the support panel member 70 of the step stool 10 of the present invention. The support panel member 70 has a support top frame end 72, a support first side frame end 74, a support second side frame end 76, and a support base frame end 78 opposite the support top frame end. The support top frame end 72 is in hinged engagement with both the top front panel 62 and the top back panel 64 at the top side middle hinge 66.

The support panel member 70 has a support length from the support first side frame end 74 to the support second side frame end 76 longer than a support height from the support top frame end 72 to the support base frame end 78. The support height corresponds to a height from the top panel 60 to the front base frame end 28 and from the top panel 60 to the back base frame end 38. In some embodiment, the support height corresponds to a height from the top panel 60 to the front leg portions 28A and a height from the top panel 60 to the back leg portions 38A.

In FIGS. 1-3 and 7, the top panel 60 has an assembled configuration corresponding to the top front panel 62 and the top back panel 64 hinged away from each other. The top surface is formed by the top front panel 62 and the top back panel 64 in this planar relationship. The user is able to step on the top surface, and the user is able to move laterally across the top surface. The top surface has a length dimension greater than the width dimension, so the step stool 10 is reinforced in the middle of the length dimension to prevent failure of the step stool 10.

In the assembled configuration, the first side front panel 42 is hinged away from the first side back panel 44, and the second side front panel 52 is hinged away from the second side back panel 54. The first side frame member 40 and the second side frame member 50 are each planar along the midline 61 and in alignment with the top panel 60. The support panel member 70 extends downward from the top panel 60 with the support base frame end 78 being aligned with the front base frame end 28 and the back base frame end 38. In some embodiments, the support frame end 78 is aligned with the front leg portions 28A and the back leg portions 38A so as to support the top panel 60 on the support panel member 70, the front frame member 20, and the back frame member 30. There are three components to support the weight of the user, and the support panel member 70 reinforces the top panel 60 at the midline 61. The weight on the midline 61 between either the front first leg portion 28A and the front second leg portion 28A or the back first leg portion 38A and the back second leg portion 38A is no longer able to sag the top panel 60.

In the storage configuration, the top panel 60 is collapsed into an at least partially folded step stool 10, as in FIG. 6. The extra component of the support panel member 70 to withstand weight and allow more movement across the top surface is further compatible with the step stool 10 being collapsible. The reinforcing by the support panel member 70 does not require removal or separate storage, when not in use.

The top panel 60 in the storage configuration corresponds to the top front panel 62 and the top back panel 64 being hinged toward each other. The top surface is no longer planar, and there is no surface to interact with the user. The top surface is folded to require less volume when being stored. The first side front panel 42 is now hinged toward the first side back panel 44, and the second side front panel 52 is hinged toward the second side back panel 54. The hinges 46 and 56 move inward toward each other. The top front panel 62 can be folded adjacent the support panel member 70, and the top back panel 64 can be folded adjacent the support panel member 70 so as to sandwich the support panel member 70. The support panel member 70 is not removed, and this larger capacity (more weight, heavier users, lateral movement across the top surface) is achieved with a reinforced step stool, that remains collapsible.

In the storage configuration, embodiments of the present invention include the front frame member 20 hinging away from the top front panel 62 at the front top frame end 22. The top front panel 62 can be made planar with the front frame member 20. The front base frame end 28 extends below the support base end 78 in the storage configuration, instead of being aligned in the assembled configuration. Similarly, the back frame member 30 hinges away from the top back panel 64 at the back top frame end 32. The back front panel 64 and the back frame member 30 are made planar. The back base frame end 38 extends below the support base end 78 in the storage configuration, instead of being aligned in the assembled configuration.

The type of step stool 10 of the present invention has a relationship between the length dimension, the front base frame end 28, the back base frame end 38, and the support base frame end 78. In some embodiments, the front length is at least twice as long as the length from the front first side frame end 42 to the back first side frame end 44. That is, the step stool 10 with a length more than twice the width is the step stool 10 of the present invention with the support panel member 70 as claimed. In other embodiments, the support length of the support panel member 70 is longer than a length from the front first side frame end 42 to the back first side frame end 44. In that case, the support length would also be longer than a length from the front second side frame end to the back second side frame end.

Embodiments of the present invention include the support panel member 70 is centered on the midline 61 of the top panel 60 between the top front panel 62 and the top back panel 64. The support panel member 70 can also be centered on the midline 61 between the first side frame member 40 and the second side frame member 50.

FIG. 7 shows embodiments of the support panel member 70, the top front panel 62, and the top back panel 64. The support top frame end 72 is comprised of a plurality of support frame teeth 73. The top front panel 62 is comprised of a plurality of top front teeth 62A, and the top back panel 64 is comprised of a plurality of top back teeth 64A. The top front teeth 62A alternate with the top back teeth 64A twice between the support frame teeth 73.

In some embodiments, the support top frame end 72 is further comprised of a plurality of support frame spacers 75. Each support frame spacer 75 aligns with a corresponding top front tooth 62A or a top back tooth 64A so as to maintain position of the support panel member 70 between the top front panel 62 and the top back panel 64.

FIGS. 1-5 and 7 also show embodiments of a handle means 68. The handle means 68 allows a user to grasp the step stool 10 in the storage configuration. The user can transport the step stool 10 by the handle means 68. In some embodiments, the handle means 68 is comprised of a plurality of slots 65, 67 in the top panel 60 and a support slot 75 in the support panel member 70. FIGS. 1-2 show the plurality of slots 65, 67 as a first slot 65 on the top front panel 62 and a second slot 67 on the top back panel 64. The first slot 65 and the second slot 67 are aligned symmetrically across the midline 61 of the top panel 60 in the assembled configuration. The first slot 65, the second slot 67, and the support slot 75 are aligned over each other in the storage configuration.

The step stool of the present invention supports the user and an additional weight carried by the user in an assembled configuration. The length dimension is greater than the width dimension so that the user can move laterally on the top surface. The user can adjust footing instead of balancing still on a limited top surface. Thus, the step stool supports vertical and lateral movement of the user, including lateral movement on top of the step stool.

The conventional step stool components do not address the problems with the larger length dimension. There is a risk of sag with the weight of the user between the leg portions of the step stool. The top panel is stressed and may collapse or break. The present invention reinforces the top panel with the support panel member. The larger and longer top panel is possible with this reinforcing. Additionally, even with the added component, the step stool remains collapsible by folding. The support panel member in the middle of the step stool is incorporated into the folding for a storage configuration. The present invention allows for the type of step stool with the larger top panel with a support to reinforce, while remaining compatible with the hinges for collapsing or folding into the storage configuration.

The foregoing disclosure and description of the invention is illustrative and explanatory thereof. Various changes in the details of the illustrated structures, construction and method can be made without departing from the true spirit of the invention.

I claim:

1. A step stool, comprising:

a front frame member having a front top frame end, a front first side frame end, a front second side frame end, and a front base frame end opposite said front top frame end, wherein a front length from said front first side frame end to said front second side frame end is longer than a front height from said front top frame end to said front base frame end, a back frame member having a back top frame end, a back first side frame end, a back second side frame end, and a back base frame end opposite said back top frame end, and wherein a back length from said back first side frame end to said back second side frame end is longer than a back height from said back top frame end to said back base frame end;

a first side frame member having a first side front panel and a first side back panel, said first side front panel being hinged to said first side back panel at a first side middle hinge, wherein said first side front panel is hinged to said front first side frame end of said front frame member, and wherein said first side back panel is hinged to said back first side frame end of said back frame member;

a second side frame member having a second side front panel and a second side back panel, said second side front panel being hinged to said second side back panel as a second side middle hinge, wherein said second side front panel is hinged to said front second side frame end of said front frame member, and wherein said second side back panel is hinged to said back second side frame end of said back frame member;

a top panel having a top front panel and a top back panel, said top front panel being hinged to said top back panel at a top side middle hinge, wherein said top front panel is hinged to said front top frame end of said front frame member, wherein said top back panel is hinged to said back top frame end of said back frame member, and wherein said first side middle hinge, said second side middle hinge, and said top side middle hinge are aligned on a midline of said top panel; and a support panel member having a support top frame end, a support first side frame end, a support second side frame end, and a support base frame end opposite said support top frame end, wherein said support top frame end is in hinged engagement with said top front panel and said top back panel at said top side middle hinge, wherein a support length from said support first side frame end to said support second side frame end is longer than a support height from said support top frame end to said support base frame end, wherein said support height corresponds to a height from said top panel to said front base frame end and from said top panel to said back base frame end, wherein said top panel has an assembled configuration corresponding to said top front panel and said top back panel hinged away from each other, said first side front panel being hinged away from said first side back panel, said second side front panel being hinged away from said second side back panel, said support panel member extending downward from said top panel, said support base frame end being aligned with said front base frame end and said back base frame end, and wherein said top panel has a storage configuration corresponding to said top front panel and said top back panel hinged toward each other, said first side front panel being hinged toward said first side back panel, said second side front panel being hinged toward said second side back panel, said top front panel being folded adjacent said support panel member, said top back panel being folded adjacent said support panel member, said support panel member being between said top front panel and said top back panel.

2. The step stool, according to claim 1, wherein said front base frame end is comprised of a plurality of front leg portions, and wherein said back base frame end is comprised of a plurality of back leg portions.

3. The step stool, according to claim 2, wherein said front leg portions are placed at opposite ends of said front base frame end, and wherein said back leg portions are placed at opposite ends of said back base frame end.

4. The step stool, according to claim 3, said front leg portions being comprised of a front first leg portion adjacent said front first side frame end and a front second leg portion adjacent said front second side frame, said back leg portions being comprised of a back first leg portion adjacent said back first side frame end and a back second leg portion adjacent said back second side frame.

5. The step stool, according to claim 3, wherein said first side front panel is comprised of a first side front leg portion, wherein said first side back panel is comprised of a first side back leg portion, wherein said first side front leg portion and said first side back leg portion are placed at opposite ends of said first side frame member, wherein said second side front panel is comprised of a second side front leg portion, wherein said second side back panel is comprised of a second side back leg portion, and wherein said second side front leg portion and said second side back leg portion are placed at opposite ends of said second side frame member.

6. The step stool, according to claim 5, wherein said first side leg front leg portion is adjacent said front first leg portion, wherein said first side leg back leg portion is adjacent said back first leg portion, wherein said second side leg front leg portion is adjacent said front second leg portion, and wherein said second side leg back leg portion is adjacent said back second leg portion.

7. The step stool, according to claim 3, wherein said support height corresponds to a height from said top panel to said front leg portions and from said top panel to said back leg portions.

8. The step stool, according to claim 3, wherein said support frame end is aligned with said front leg portions and said back leg portions so as to support the top panel on said support panel member, the front frame member, and the back frame member.

9. The step stool, according to claim 1, wherein said front frame member hinges away from said top front panel at said front top frame end, said front base frame end extending below said support base end in said storage configuration, and wherein said back frame member hinges away from said top back panel at said back top frame end, said back base frame end extending below said support base end in said storage configuration.

10. The step stool, according to claim 1, wherein said front length is at least twice as long as said length from said front first side frame end to said back first side frame end.

11. The step stool, according to claim 1, wherein said support length is longer than a length from said front first side frame end to said back first side frame end, and wherein said support length is longer than a length from said front second side frame end to said back second side frame end.

12. The step stool, according to claim 1, wherein said support panel member is centered on said midline of said top panel between said top front panel and said top back panel.

13. The step stool, according to claim 12, wherein said support panel member is centered on said midline between said first side frame member and said second side frame member.

14. The step stool, according to claim 1, wherein said support top frame end is comprised of a plurality of support frame teeth, wherein said top front panel is comprised of a plurality of top front teeth, wherein said top back panel is comprised of a plurality of top back teeth, and wherein said top front teeth alternate with said top back teeth twice between said support frame teeth.

15. The step stool, according to claim 14, wherein said support top frame end is further comprised of a plurality of support frame spacers, and wherein each support frame spacer aligns with a corresponding top front tooth or a top back tooth so as to maintain position of said support frame member between said top front panel and said top back panel.

16. The step stool, according to claim 1, further comprising a handle means 68 for said storage configuration.

17. The step stool, according to claim 16, wherein said handle means is comprised of a plurality of slots in said top panel and a support slot in said support panel member.

18. The step stool, according to claim 17, wherein said plurality of slots is comprised of a first slot on said top front panel and a second slot on said top back panel.

19. The step stool, according to claim 18, wherein said first slot and said second slot are aligned symmetrically across said midline of said top panel in the assembled configuration.

20. The step stool, according to claim 18, wherein said first slot, said second slot, and said support slot are aligned over each other in the storage configuration.

* * * * *